US009174347B2

(12) United States Patent
Hongquan et al.

(10) Patent No.: US 9,174,347 B2
(45) Date of Patent: Nov. 3, 2015

(54) RETRACTABLE UTILITY KNIFE

(71) Applicant: Meridian International Co., Ltd., Songjiang, Shanghai (CN)

(72) Inventors: Zhang Hongquan, Shanghai (CN); Wang Zhengguo, Shanghai (CN)

(73) Assignee: MERIDIAN INTERNATIONAL CO., LTD. (CN)

( * ) Notice: Subject to any disclaimer, the term of this patent is extended or adjusted under 35 U.S.C. 154(b) by 160 days.

(21) Appl. No.: 13/848,815

(22) Filed: Mar. 22, 2013

(65) Prior Publication Data

US 2013/0247382 A1 Sep. 26, 2013

Related U.S. Application Data

(60) Provisional application No. 61/614,890, filed on Mar. 23, 2012.

(30) Foreign Application Priority Data

| | | |
|---|---|---|
| Sep. 26, 2012 | (CN) | 2012 1 0364392 |
| Sep. 26, 2012 | (CN) | 2012 2 0495738 U |
| Mar. 14, 2013 | (CN) | 2013 1 0080788 |
| Mar. 14, 2013 | (CN) | 2013 2 0115044 U |

(51) Int. Cl.
*B26B 1/08* (2006.01)
*B26B 5/00* (2006.01)

(52) U.S. Cl.
CPC .. *B26B 5/001* (2013.01); *B26B 1/08* (2013.01)

(58) Field of Classification Search
CPC ..... B26B 1/02; B26B 1/08; B26B 5/003
USPC ..... 30/151, 155, 156, 162
See application file for complete search history.

(56) References Cited

U.S. PATENT DOCUMENTS

| | | | | |
|---|---|---|---|---|
| 4,713,885 | A * | 12/1987 | Keklak et al. | 30/162 |
| 5,101,564 | A * | 4/1992 | Melter | 30/319 |
| 5,355,588 | A * | 10/1994 | Brandenburg et al. | 30/319 |
| 6,148,520 | A * | 11/2000 | Berns | 30/2 |
| 6,557,262 | B1 * | 5/2003 | Clemence et al. | 30/156 |
| 6,898,858 | B1 * | 5/2005 | Spell | 30/512 |
| 7,520,059 | B2 | 4/2009 | Ranieri et al. | |
| 7,765,701 | B2 * | 8/2010 | Okada | 30/162 |
| 7,797,836 | B2 | 9/2010 | Ranieri et al. | |
| 8,056,241 | B2 * | 11/2011 | Davis et al. | 30/162 |
| 8,353,109 | B2 * | 1/2013 | Rohrbach | 30/162 |
| 8,561,305 | B2 * | 10/2013 | Davis et al. | 30/162 |
| 8,707,566 | B2 * | 4/2014 | Rohrbach | 30/162 |
| 8,752,297 | B2 * | 6/2014 | Rohrbach | 30/158 |
| 8,776,380 | B1 * | 7/2014 | Quimby et al. | 30/155 |
| 2003/0154606 | A1 * | 8/2003 | Saunders et al. | 30/162 |
| 2004/0237312 | A1 * | 12/2004 | Hernandez et al. | 30/162 |
| 2009/0260235 | A1 * | 10/2009 | Rohrbach | 30/162 |

(Continued)

FOREIGN PATENT DOCUMENTS

| | | | |
|---|---|---|---|
| DE | 30 32 688 | A1 * | 3/1981 |
| EP | 2 641 705 | * | 9/2013 |

*Primary Examiner* — Hwei C Payer
(74) *Attorney, Agent, or Firm* — Jason R. Sytsma; Shuttleworth & Ingersoll, PLC

(57) ABSTRACT

A utility knife has a handle and a blade holder that holds a utility blade for selective removal and replacement of the utility blade. The blade holder is pivotally carried by the handle for pivotal movement in an arcuate path relative to the handle between a retracted position and an extended position.

11 Claims, 8 Drawing Sheets

(56) References Cited

U.S. PATENT DOCUMENTS

2010/0325899 A1 12/2010 Seber et al.
2011/0035947 A1* 2/2011 Rohrbach ..... 30/162
2012/0234218 A1* 9/2012 Martin ..... 111/118
2013/0061476 A1* 3/2013 Lutgen et al. ..... 30/151
2013/0247382 A1* 9/2013 Hongquan et al. ..... 30/156

* cited by examiner

RETRACTABLE UTILITY KNIFE

This application claims priority to the following applications:

U.S. Provisional Application 61/614,890 filed Mar. 23, 2012

Chinese Application 201210364392.0 filed Sep. 26, 2012

Chinese Application 201220495738.6 filed Sep. 26, 2012

Chinese Application 201310080788.7 filed Mar. 14, 2013

Chinese Application 201320115044.x filed Mar. 14, 2013

The entirety of all five applications are incorporated by reference herein.

FIELD OF THE INVENTION

This invention relates to a utility knives and more specifically to utility knives with a retractable blade.

BACKGROUND

A conventional utility knife includes a long handle with a blade holder slideably disposed within the handle. A trapezoidal utility blade detachably mounts to the blade holder. A standard trapezoidal blade has a cutting edge disposed on its longest edge and one or more mounting notches disposed on an opposite edge. When the blade holder is in a retracted position, the blade is disposed within and protected by the handle. When the blade holder is moved into an extended position, a small portion of the blade becomes exposed. The conventional handle is relatively long so as to provide enough longitudinal space for a users hand to supply sufficient leverage to the blade during a cutting action or to enable the user to grip the handle without being overly close to the blade's cutting edge. Unfortunately, the length and size of this handle makes the utility knife large and cumbersome when the knife is not being used.

SUMMARY

A utility knife is disclosed. The utility knife has a handle and a blade holder that holds a utility blade for selective removal and replacement of the utility blade. The blade holder is pivotally carried by the handle for pivotal movement in a curvilinear path relative to the handle between a retracted position and an extended position. In the extended position, the blade holder projects from an aperture in a front side of the utility knife. As the blade moves in its curvilinear path, the blade holder can project from a second aperture in a top side of the utility knife.

A first linkage and a second linkage combine the blade holder to the handle, which together create a four-bar mechanism that enables the blade holder to move in its curvilinear path between the respective positions. The blade holder can have a slot with a vertical portion and a horizontal portion, which cooperate to provide the blade holder with the ability to move in the curvilinear path with respect to the handle by providing a space for a button assembly to travel. The button assembly pushes the blade holder between the retracted position and the extended position and the blade holder moves with respect to the button assembly.

BRIEF DESCRIPTION OF THE DRAWINGS

Referring tow to the drawings which form a part of this original disclosure.

DETAILED DESCRIPTION OF THE DRAWINGS

Figure 1:
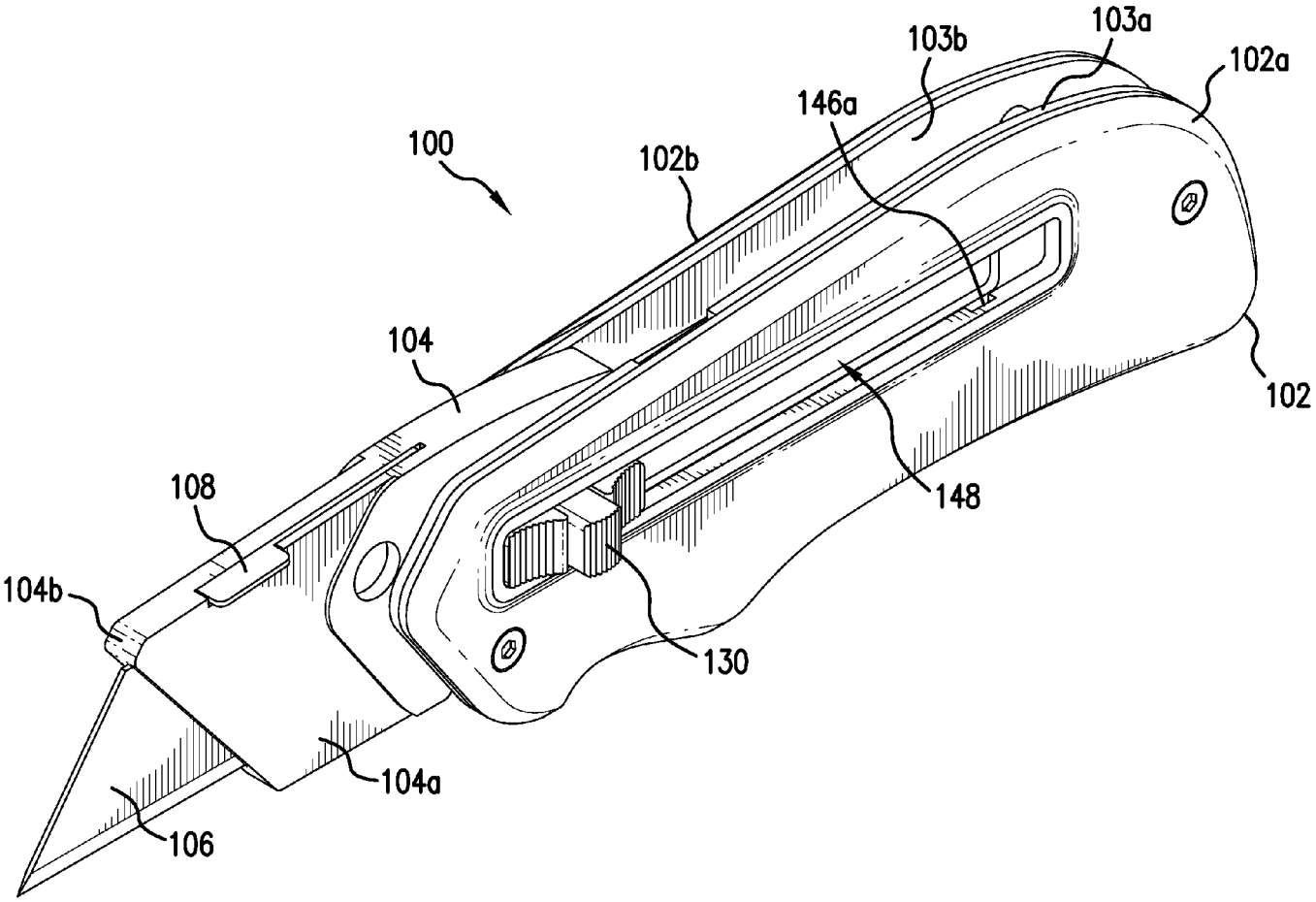
FIG. 1 is a left-side perspective view of a utility knife according to an embodiment of this disclosure and showing the blade in an extended position.

FIGS. 1-4 illustrate a compact utility knife 100 constructed in accordance with the principles of the present disclosure. As shown in FIG. 1 knife 100, includes a handle 102, a blade holder 104 pivotally connected to handle 102 to move in a curvilinear path between an extended, operative position and a retracted, safety position, a trapezoidal utility blade 106 detachably mounted to the blade holder 104, and a blade lock mechanism 107 for selectively locking the blade 106 onto blade holder 104.

Figure 2:
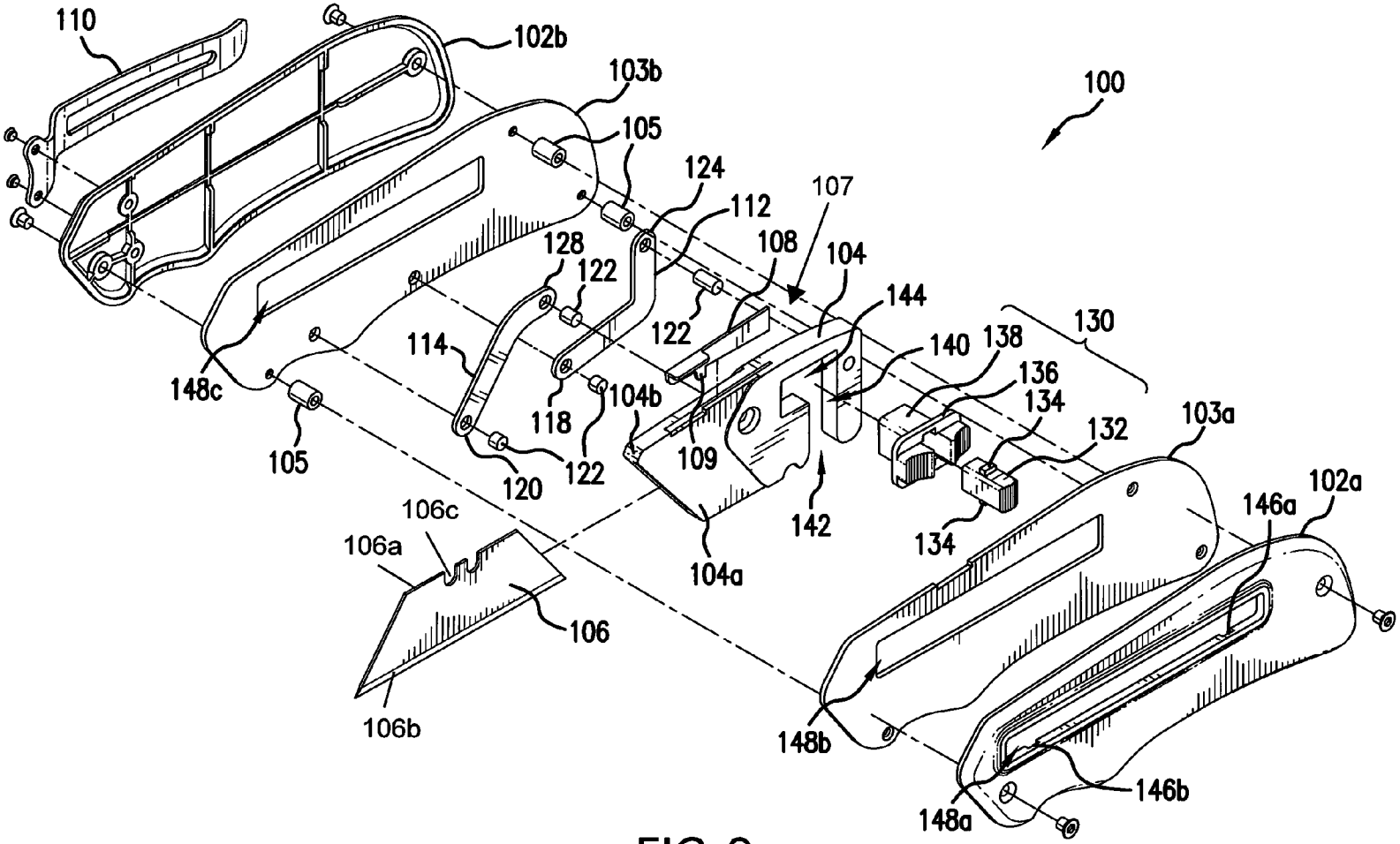
FIG. 2 is an exploded view of the utility knife of FIG. 1.

As shown in FIG. 2, handle 102 comprises left-side handle portion 102*a* and right-side handle portion 102*b* that are fastened together with suitable fasteners to hold between them a corresponding left-side plate 103*a* and right-side plate 103*b*. One or more spacers 105 positions left-side plate 103*a* from right-side plate 103*b* a sufficient distance apart so that blade holder 104 can extend out apertures in a front face and top side of handle 102. A belt clip 110 may be fastened in any suitable manner to right-side handle portion 102*b*. While the illustrated handle 102 comprises a variety of components, one or more of these components may be omitted without deviating from the scope of this disclosure.

Blade holder 104 comprises left and right blade holder portions 104*a*, 104*b* that are fastened to each other using rivets or other single fastening mechanisms (e.g., screws, integral formation, glue, welding, etc.). In another contemplated embodiment, blade holder 104 is a single, integrally formed member rather than two members secured together.

Blade holder 104 includes blade lock mechanism 107 that is received in a slot in the top edge of blade holder 104 to selectively hold blade 106 in blade holder 104. Blade lock assembly 107 includes a blade lock 108 biased by a biasing member to pivot between a blade-lock position and a blade-release position. To hold blade 106 in blade holder 104, tab 109 on blade lock 108 is configured to align with a notch in blade 106.

Utility blade 106 includes first and second parallel linear edges 106*a*, 106*b*, a mounting notch 106*c* formed in first linear edge 106*a*, and a cutting edge integral with second linear edge 106*b*. When blade 106 is inserted in the slot in the front edge of blade holder 104, the tab 109 on blade lock 108 engages mounting notch 106*c* and locks utility blade 106 to blade holder 104. When blade holder 104 is in an extended position, utility blade 106 extends out of the aperture in the front face of handle 102. When blade holder 104 is in a retracted position, utility blade 106 is fully disposed in handle 102.

Figure 3A:
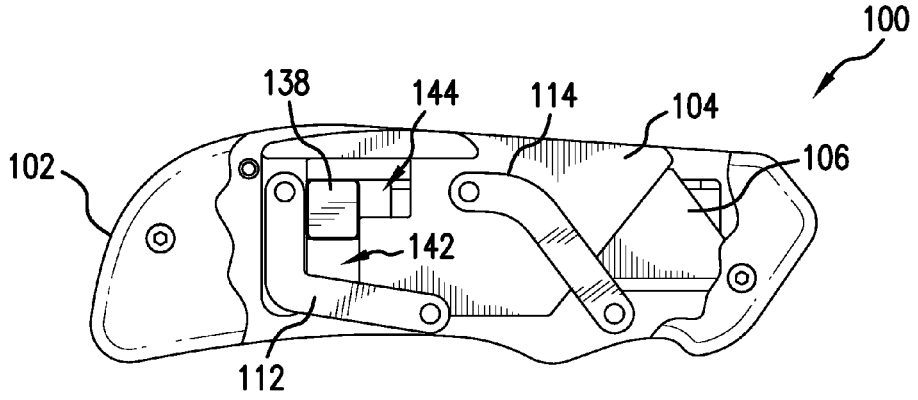
FIG. 3*a* is a left-side cut-away view of the utility knife of FIG. 1 with the blade in a retracted position.
Figure 3B:
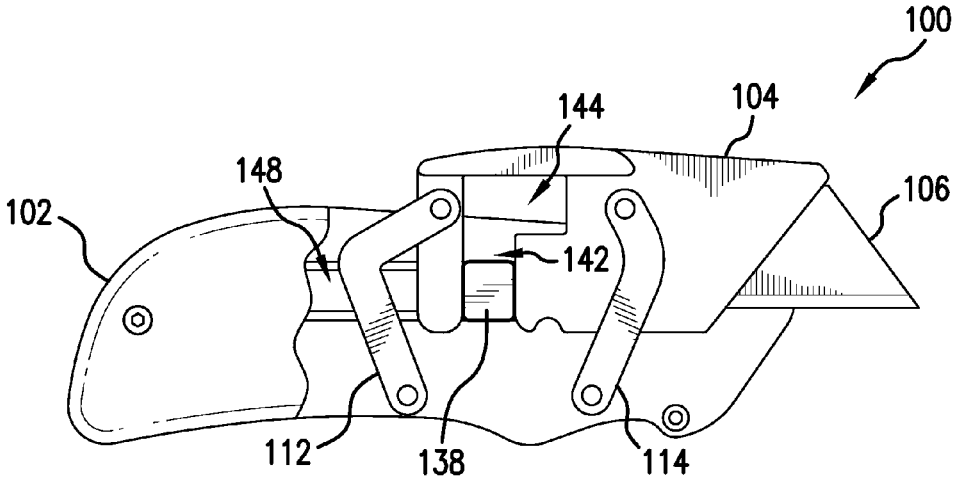
FIG. 3*b* is a left-side cut-away view of the utility knife of FIG. 1 with the blade in an intermediate position.
Figure 3C:
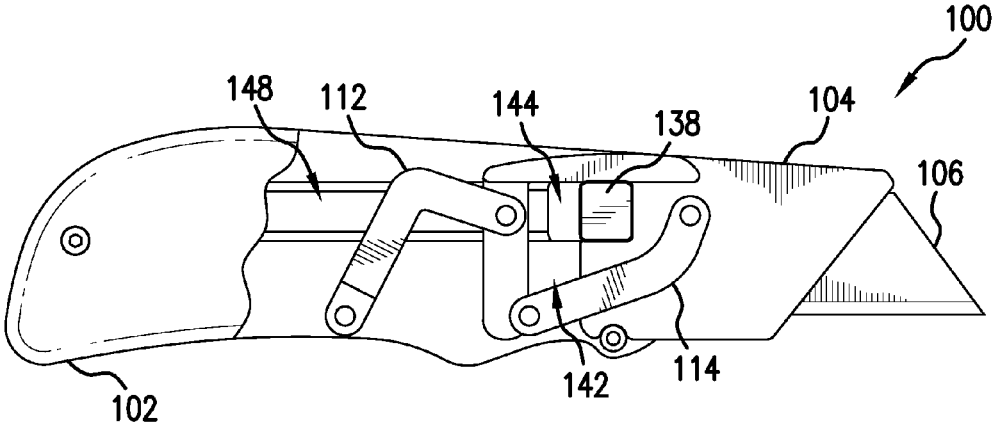
FIG. 3*c* is a left-side cut-away view of the utility knife of FIG. 1 with the blade in a fully extended position.

As shown in FIGS. 3A-3C, blade holder 104 is pivotally combined to handle 102 to move about at least two axes in a curvilinear path between a retracted position (shown in FIG. 3A) and an extended position (shown in FIG. 3C). Blade holder 104 can be connected to handle 102 by means that is movable about at least two axes for connecting blade holder 104 to handle 102 for movement in a curvilinear path relative to handle 102 between a retracted position and an extended position. A first linkage 112 and a second linkage 114 are each combined to handle 102 at one end and to blade holder 104 at the other end to create a four-bar mechanism that controls the movement of blade holder 104.

More specifically, first linkage 112 is fastened at its lower portion 118 with rivets 122 to right-side plate 103*b* and second linkage 114 is fastened at its lower portion 120 with rivets 122 to right-side plate 103*b*. First linkage 112 has an upper portion 124 that fastened with rivets 122 to blade holder 104 and second linkage 114 has an upper portion 128 that is similarly fastened with rivets 122 to blade holder 104.

The four-bar mechanism is defined by first linkage 112 and second linkage 114 as the pivoting links. Second plate 103*b*, and more specifically, an integral portion of second plate 103*b* measured by the distance between lower portion 118 of first linkage 112 and lower portion 120 of second linkage 114, define a fixed frame of the four-bar mechanism. Blade holder 104 and more specifically, an integral portion of blade holder 104 measured by the distance between upper portion 124 of first linkage 112 and upper portion 128 of second linkage 114, define a floating link. This four-bar mechanism moves blade holder 104, as shown in FIGS. 3A-3C and 4A-4*c*, in a curvilinear path between the fully retracted position and the fully extended position.

A button assembly 130 projects from left handle side 102*a* to enable a user to easily move blade holder 104 between its respective positions. Button assembly 130 includes a button 132 which has on opposite sides a pair of protrusions 134. Button 132 fits in a slot in a housing 136 and is biased outward by a spring (not shown) in the housing 136, so that it projects outwardly from housing 136. Housing 136 has a projection 138 that cooperates with a slot 140 in blade holder 104. Slot 140 has a vertical portion 142 perpendicular to a horizontal portion 144, which together provide a path of travel for projection 138 of housing 136.

Figure 4A:
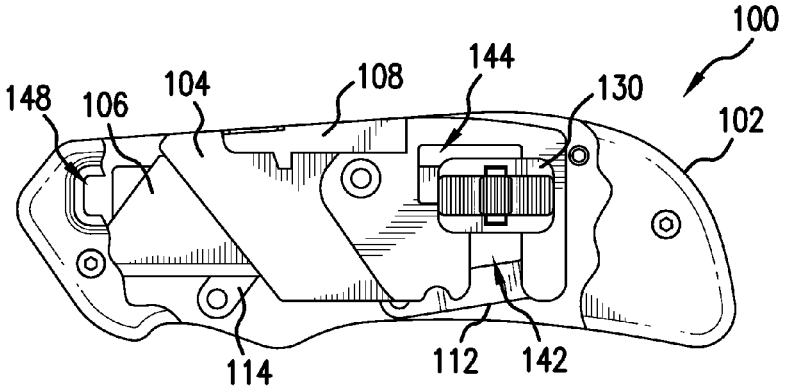
FIG. 4*a* is a right-side cut-away view of the utility knife of FIG. 1 with the blade in a retracted position.
Figure 4B:
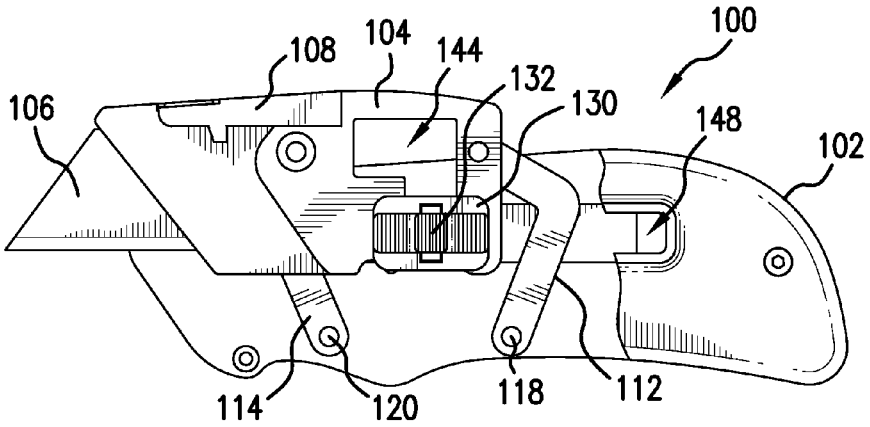
FIG. 4*b* is a right-side cut-away view of the utility knife of FIG. 1 with the blade in an intermediate position.
Figure 4C:
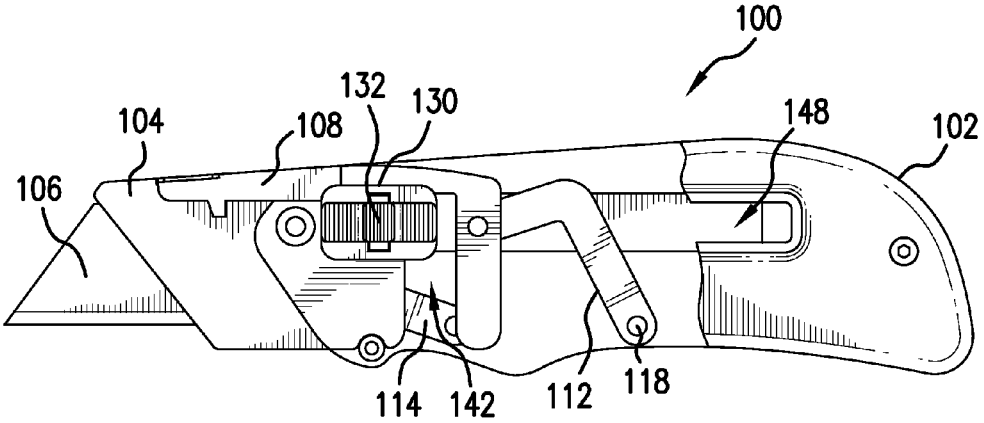
FIG. 4*c* is a right-side cut-away view of the utility knife of FIG. 1 with the blade in a fully extended position.

As blade holder 104 moves between its respective positions, button 132 of button assembly 130 moves across a slot 148 while projection 138 of button assembly 130 pushes blade holder 104. More specifically, slot 148 includes aligned slots 148*a*, 148*b*, and 148*c* in left handle side 102*a*, left-side plate 103*a*, and right-side plate 103*b*, respectively, to secure button assembly 130 to both sides of handle 102. As projection 138 pushes blade holder 104 as shown in FIGS. 3A-3C, the four-bar mechanism forces blade holder 104 to arc upwardly as the vertical portion 142 of slot 140 moves with respect to projection 138. When blade holder 104 approaches its fully extended position projection 138 slides forward along horizontal portion 144 of slot 140. FIGS. 4A-4C similarly show blade holder 104 moving between its respective positions. Thus, during extension and retraction of blade holder 104, button 132 moves linearly across slot 148 of handle 102 as the button assembly 130 pushes blade holder 104. As blade holder 104 moves, first linkage 112 and second linkage 114 pivot about their axes to move blade holder 104 in its curvilinear path.

Blade holder 104 can be locked in the retracted position and the extended position. Protrusions 134 on button 132 cooperate with a first notch 146*a* and a second notch 146*b* in slot 148 on left-side handle portion 102*a*. In a retracted position, protrusion 134 on button 132 engages first notch 146*a* to hold blade holder 104 in the retracted position. In an extended position, protrusion 134 engages second notch 146*b* to hold blade holder 104 in the extended position. To unlock blade holder 104 and move blade holder 104 to an extended position, a user presses inward button 132 to disengage protrusion 134 from first notch 146*a*. Button assembly 130 can then be slid across slot 148 to the engaged position where protrusion 134 of button 132 engages second notch 146*b*.

Figure 5:
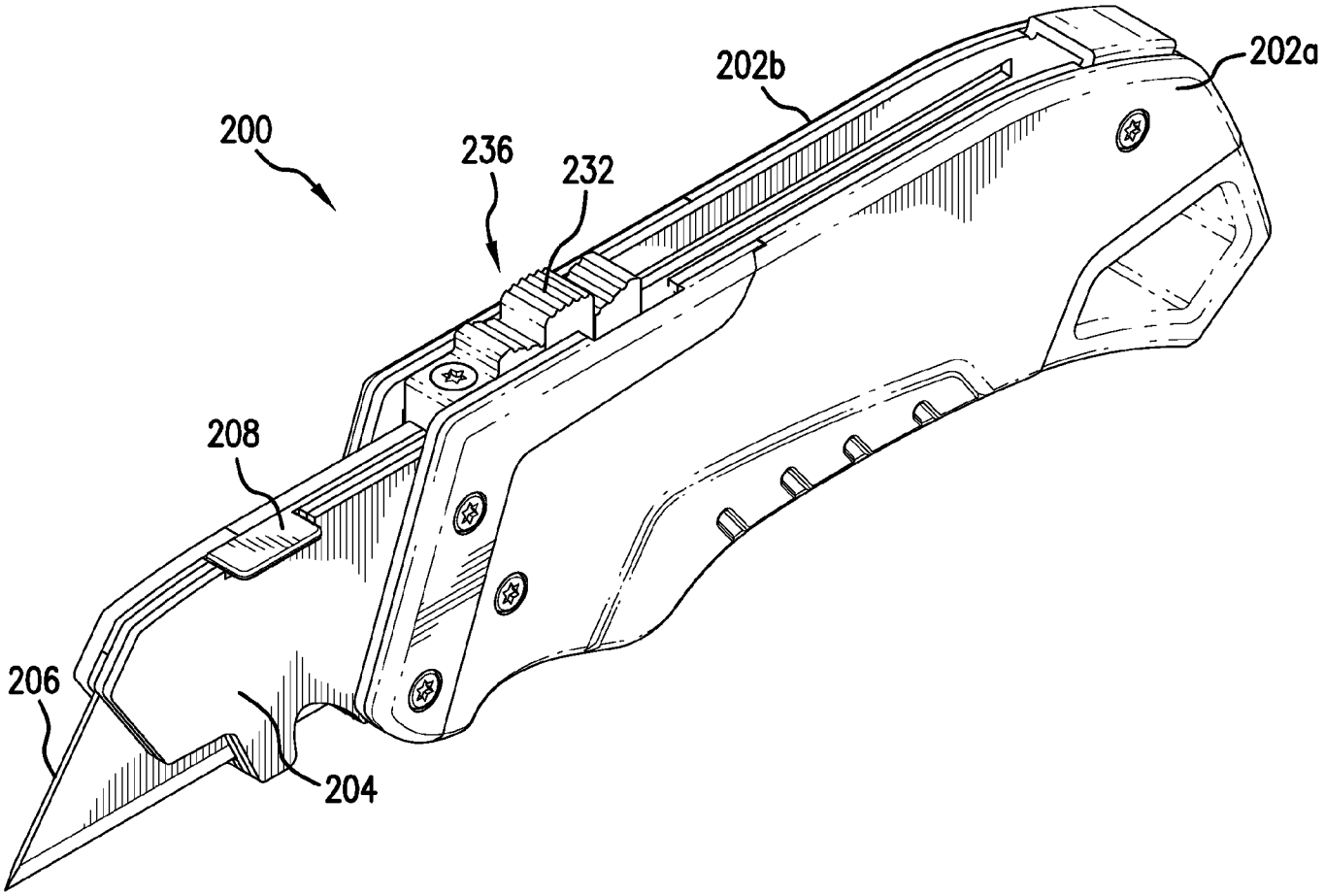
FIG. 5 is a left-side perspective view of the utility knife according to another embodiment of this disclosure and showing the blade in an extended position.

FIGS. 5-8 illustrate another embodiment of a compact utility knife 200 constructed in accordance with the principles of the present disclosure. As shown in FIG. 5, knife 200, includes a handle 202, a blade holder 204 pivotally connected to handle 202, a trapezoidal utility blade 106 detachably mounted to the blade holder 204, and a blade lock mechanism 207 for selectively locking the blade 206 onto blade holder 204.

Figure 6:
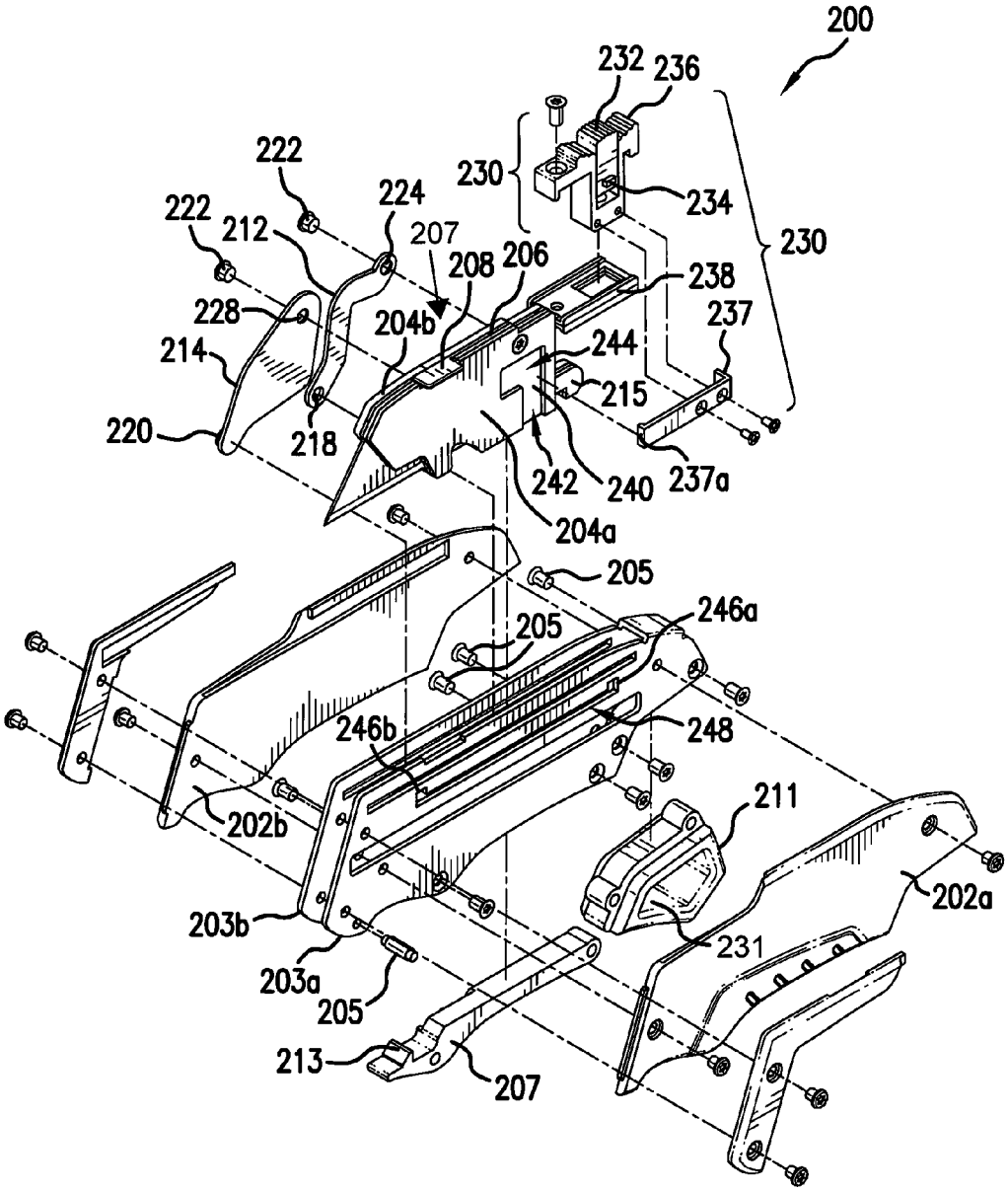
FIG. 6 is an exploded view of the utility knife of FIG. 5.

As shown in FIG. 6, handle 202 comprises left side portion 202*a* and right-side portion 202*b* that are fastened together with suitable fasteners to hold between them a corresponding left-side plate 203*a* and right-side plate 203*b*. One or more spacers 205 positions left side plate 203*a* from right-side plate 203*b* a sufficient distance apart so that blade holder 204 can extend out apertures in a front face and top side of handle 202. A bottom portion 209 and a rear portion 211 fit together beneath left-side plate 203*a* and right-side plate 203*b* to cover the bottom side of handle 202. Rear portion 211 can be formed with an aperture 231, so handle 202 can be connected to a key ring or the like. Bottom portion 209 is formed with a catch 213 to arrest blade holder 204's movement in the extended position. While the illustrated handle 202 comprises a variety of components, one or more of these components may be omitted without deviating from the scope of this disclosure.

Blade holder 204 comprises left and right blade holder portions 204*a*, 204*b* that are fastened to each other using rivets or other single fastening mechanisms (e.g., screws, integral formation, glue, welding, etc.). In another contemplated embodiment, blade holder 104 is a single, integrally formed member rather than two members secured together. Blade holder 204 has a hook 215 positioned on its rear side to cooperate with catch 213 on bottom portion 209 of handle 202. As blade holder 204 is moved to the engaged position, its movement is arrested by the cooperation of hook 215 and catch 213.

Blade holder 204 includes blade lock mechanism 207 that is received in a slot in the top edge of blade holder 204 to selectively hold blade 206 in blade holder 204. Blade lock mechanism 207 includes a blade lock 208 biased by a biasing member to pivot between a blade-lock position and a blade-release position in a manner similar to the manner described for blade lock mechanism 107. Similarly, to hold blade 206 in blade holder 204, a tab on blade lock 208 is configured to align with a notch in blade 206. Blade 206 is constructed in a manner similar to blade 106.

Figure 7A:
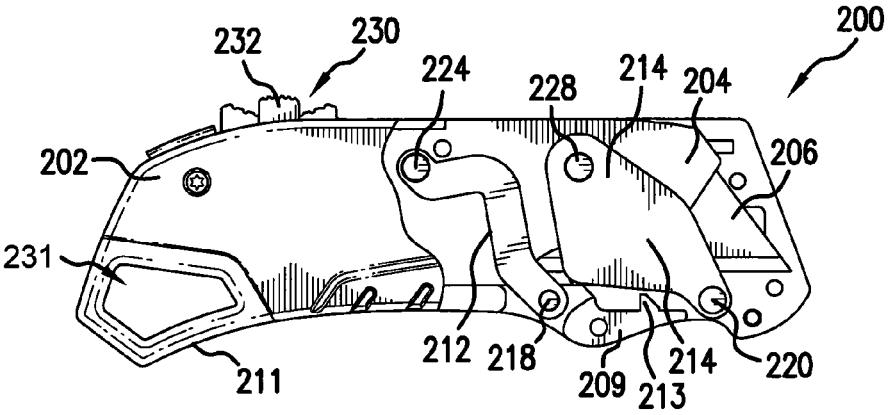
FIG. 7*a* is a left-side cut-away view of the utility knife of FIG. 5 with the blade in a retracted position.
Figure 7B:
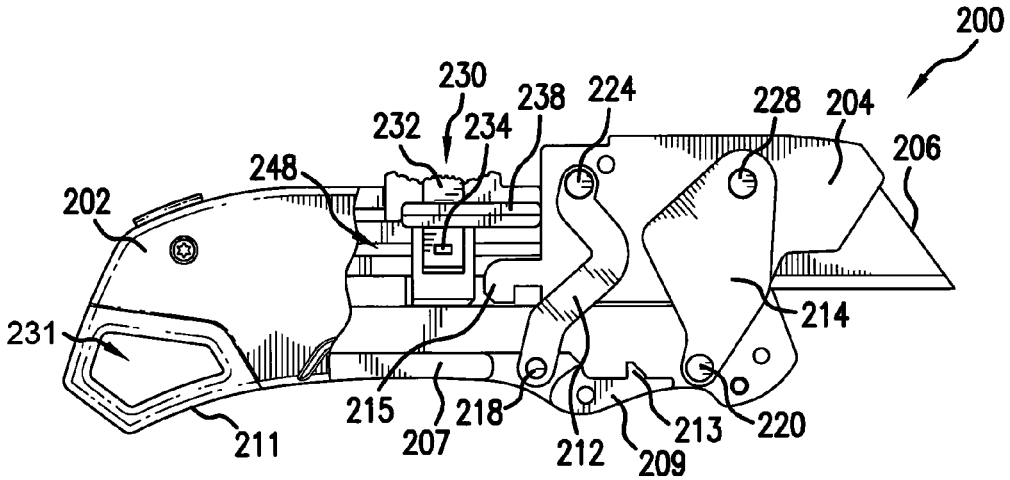
FIG. 7*b* is a left-side view cut-away of the utility knife of FIG. 5 with the blade in an intermediate position.
Figure 7C:
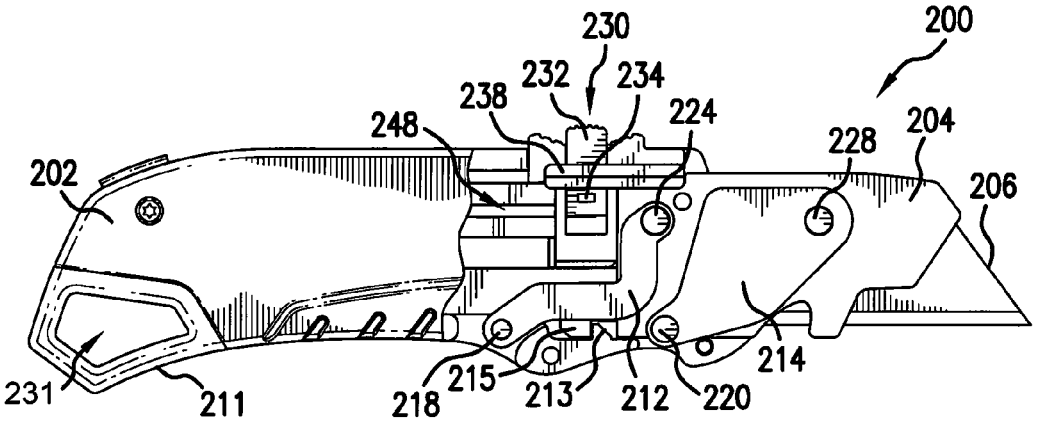
FIG. 7*c* is a left-side view cut-away of the utility knife of FIG. 5 with the blade in a fully extended position.

As shown in FIGS. 7A-7C, blade holder 204 is pivotally combined to handle 202 to move in a curvilinear path between a retracted position (shown in FIG. 7A) and an extended position (shown in FIG. 7C). A first linkage 212 and a second linkage 214 are combined to handle 202 at one end and to blade holder 204 at the other end to create a four-bar mechanism that controls the movement of blade holder 204.

More specifically, first linkage 212 is fastened at its lower portion 218 with rivets to right-side plate 203*b* and second linkage 214 is fastened at its lower portion 220 with rivets to left-side plate 203*b*. First linkage 212 has an upper portion 224 that is fastened with rivets 222 to blade holder 204 and second linkage 214 has an upper portion 228 that is similarly fastened with rivets 222 to blade holder 204.

The four-bar mechanism is defined by first linkage 212 and second linkage 214 as the pivoting links. Second plate 203*b*, and more specifically, an integral portion of second plate 203*b* measured by the distance between lower portion 218 of first linkage 212 and lower portion 220 of second linkage 214 define a fixed frame of the four-bar mechanism. Blade holder 204, and more specifically, an integral portion of blade holder 204 measured by the distance between upper portion 224 of first linkage 212 and upper portion 228 of second linkage 214 define a floating link. This four-bar mechanism moves blade holder 204, as shown in FIGS. 7A-7B, in a curvilinear path between the fully retracted position and the fully extended position.

A button assembly 230 projects from a top side of handle 202 to enable a user to easily move blade holder 204 between its respective positions. Button 232 is part of a button assembly 230. Button assembly 230 includes a housing 236 and a spring to bias outward button 232 from a slot in housing 236. Housing 236 is combined to a plate 238 and a guide 237, which cooperate with a slot 240 in blade holder 204. Slot 240 has a vertical portion 242 perpendicular to a horizontal portion 244, which together provide a path of travel for guide 237.

As blade holder 204 moves to the extended position, guide 237 moves across a slot 248 in left side plate 203*a* while plate 238 of button assembly 230 pushes blade holder 204. As plate 238 pushes blade holder 204, as shown in FIGS. 7A-7C, the four-bar mechanism forces blade holder 204 to arc upwardly as vertical portion 242 of slot 240 in blade holder 204 moves with respect to plate 238. When blade holder 204 approaches its fully extended position, plate 238 slides forward along horizontal portion 244 of slot 240 in blade holder 204.

As blade holder 204 moves to the retracted position, guide 237 moves across a slot 248 in left side plate 203*a*. A catch 237*a* grabs the side of slot 240 to pull blade holder 204 toward the retracted position. As catch 237*a* pulls blade holder 204, as shown in FIG. 8B, blade holder 204 arcs upwardly as vertical portion 242 of slot 240 in blade holder 204 moves with respect to catch 237*a* of guide 237. When blade holder 204 is in its fully retracted position, catch 237*a* of guide 237 holds blade holder 204 in position until button 232 releases protrusion 234 of button 232 from a first notch 246*a* in a slot 248 (discussed below).

Figure 8A:
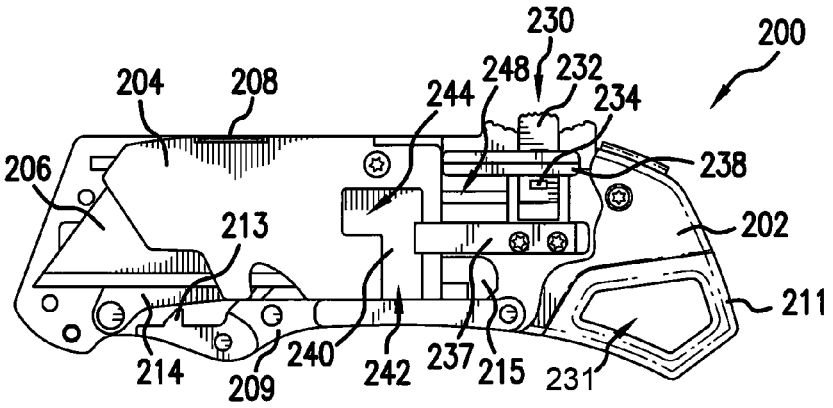
FIG. 8*a* is a right-side view cut-away of the utility knife of FIG. 5 with the blade in a retracted position.
Figure 8B:
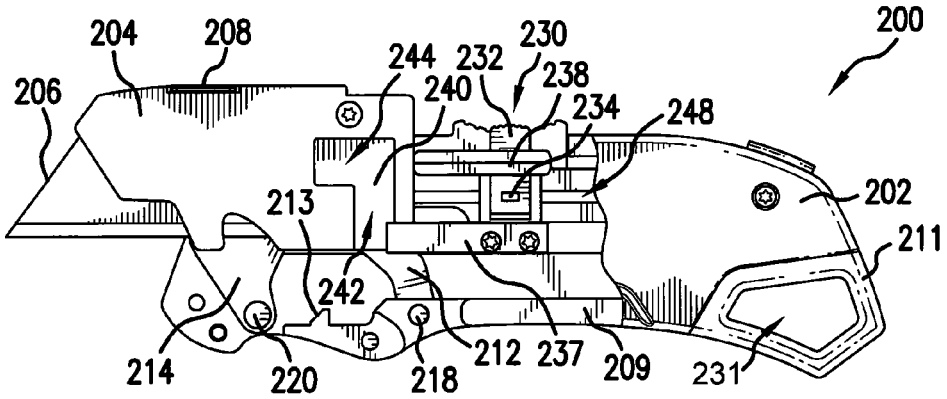
FIG. 8*b* is a right-side cut-away view of the utility knife FIG. 5 with the blade in an intermediate position.
Figure 8C:
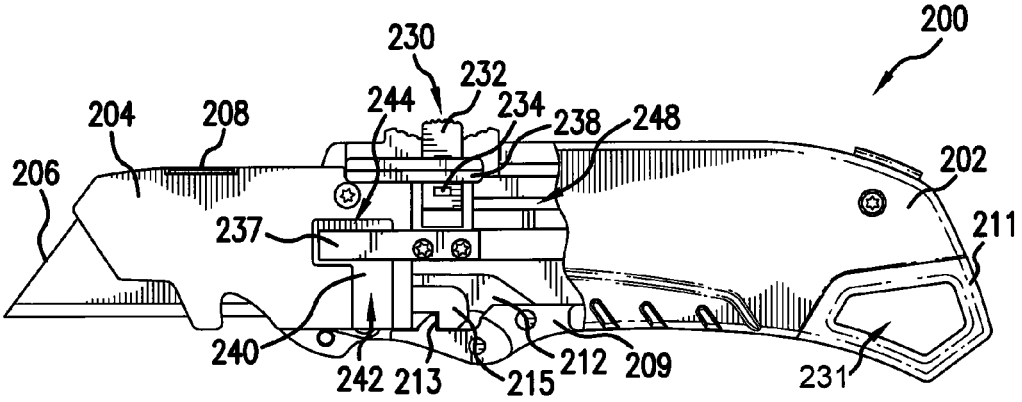
FIG. 8*c* is a right-side cut-away view of the utility knife of FIG. 5 in a fully extended position.

FIGS. 8A-8C similarly show blade holder 204 moving between its respective positions. Thus, during extension and retraction of blade holder 204, button 232 moves generally linearly across the top of handle 102 as the plate 238 pushes blade holder 204. As blade holder 204 moves, first linkage 212 and second linkage 214 pivot about their axes to move blade holder 204 in its curvilinear path.

Blade holder 204 can be locked in the retracted position and the extended position. Protrusion 234 on button 232 cooperates with a first notch 246*a* and a second notch 246*b* in a slot 248 on left side plate 203*a*. In a retracted position, protrusion 234 on button 232 engages first notch 246*a* to hold blade holder 204 in the retracted position. In an extended position, protrusion 234 engages second notch 246*b* to hold blade holder 204 in the extended position. To unlock blade holder 204 and move blade holder 204 to an extended position, a user presses inward button 232 to disengage protrusion 234 from first notch 246*a*. Button assembly 230 can then be slid across slot 248 to the engaged position where protrusion 234 of button 232 engages second notch 246*b*.

Various aspects of any of the embodiments can be combined in different combinations than the ones shown to create new embodiments that fall within the scope of the appended claims.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising."

What is claimed is:

1. A utility knife, comprising:

a handle;

a blade holder connected to the handle by means that is movable about at least two axes for connecting the blade holder to the handle for movement in a single curvilinear path relative to the handle between a retracted position and an extended position;

a button assembly that is moveable along a transverse linear path with respect to the handle and that cooperates with the blade holder to move the blade holder to the extended position; and a utility blade replaceably attached to the blade holder for selective removal and replacement of the utility blade.

2. The utility knife of claim 1, wherein the handle further comprises a first aperture from which the blade holder projects in the extended position.

3. The utility knife of claim 2, wherein the handle further comprises a second aperture from which the blade holder projects as it is moved between the retracted position and the extended position.

4. A utility knife, comprising:

a handle including a right side, a left side, a front face, and a top side, and a first aperture and a second aperture;

a blade holder connected to the handle by means that is movable about at least two axes for connecting the blade holder to the handle for movement in a curvilinear path relative to the handle between a retracted position and an extended position;

a utility blade replaceably attached to the blade holder for selective removal and replacement of the utility blade, wherein the first aperture is in the front face from which the blade holder projects in the extended position and the second aperture is in the top side from which the blade holder projects as it is moved between the retracted position and the extended position.

5. The utility knife of claim 4, wherein the blade holder further comprises a slot having a vertical portion perpendicular to a horizontal portion, which cooperate to provide the blade holder with ability to move in the curvilinear path with respect to the handle.

6. The utility knife of claim 5, the utility knife further comprises a button assembly that cooperates with the slot in the blade holder, wherein the button assembly pushes the blade holder to the extended position and the blade holder moves with respect to the button assembly.

7. A utility knife, comprising:

a handle;

a blade holder connected to the handle by means that is movable about at least two axes for connecting the blade holder to the handle for movement in a curvilinear path relative to the handle between a retracted position and an extended position with a top surface of the blade holder maintaining a substantially consistent perpendicular orientation with respect to a right side of the handle; and a utility blade replaceably attached to the blade holder for selective removal and replacement of the utility blade.

8. The utility knife of claim 7, wherein the handle further comprises a first aperture from which the blade holder projects in the extended position, a second aperture from which the blade holder projects as it is moved between the retracted position and the extended position, the right side, a left side, a front face, and a top side, wherein the first aperture is in the front face and the second aperture is in the top side.

9. The utility knife of claim 8, wherein the blade holder further comprises a slot having a vertical portion perpendicular to a horizontal portion, which cooperate to provide the blade holder with ability to move in the curvilinear path with respect to the handle.

10. The utility knife of claim 9, and further comprising a button assembly that cooperates with the slot in the blade holder, wherein the button assembly pushes the blade holder to the extended position and the blade holder moves with respect to the button assembly.

11. The utility knife of claim 7, and further comprising at least two axes about which the blade holder is pivotally attached to the handle.

* * * * *